US007542699B2

(12) United States Patent
Kawasaki

(10) Patent No.: US 7,542,699 B2
(45) Date of Patent: Jun. 2, 2009

(54) IMAGE FORMING APPARATUS HAVING SLIDABLE CONTROL PORTION

(75) Inventor: Kotaro Kawasaki, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 152 days.

(21) Appl. No.: 11/471,074

(22) Filed: Jun. 20, 2006

(65) Prior Publication Data

US 2007/0077108 A1 Apr. 5, 2007

(30) Foreign Application Priority Data

Aug. 22, 2005 (JP) ..... 2005-239737

(51) Int. Cl.
*G03G 15/00* (2006.01)

(52) U.S. Cl. ..... 399/110

(58) Field of Classification Search ..... 399/110, 399/107

See application file for complete search history.

(56) References Cited

U.S. PATENT DOCUMENTS

2005/0175371 A1* 8/2005 Kunugi ..... 399/107
2006/0171734 A1* 8/2006 Maeda ..... 399/81
2007/0147869 A1* 6/2007 Akiyama et al. ..... 399/81

FOREIGN PATENT DOCUMENTS

| | | | |
|---|---|---|---|
| JP | 2002351282 | | 12/2002 |
| JP | 2002361968 | A * | 12/2002 |
| JP | 2003143346 | A * | 5/2003 |
| JP | 2005234222 | A * | 9/2005 |
| JP | 2006010867 | A * | 1/2006 |

* cited by examiner

*Primary Examiner*—Quana M Grainger
(74) *Attorney, Agent, or Firm*—The Webb Law Firm

(57) ABSTRACT

The present invention provides an image forming apparatus in which a control portion of an image forming unit and an opening cover from which an internal portion of an apparatus main body including the image forming unit can be exposed are provided on an upper face, a front face, or a portion from the upper face to the front face of the apparatus main body. The control portion is attached so as to be capable of sliding to an outer side with respect to the apparatus main body. At least a part of the internal portion of the apparatus main body is exposed in accordance with an opening movement of the opening cover and a sliding movement of the control portion.

7 Claims, 6 Drawing Sheets

(a)

(b)

(a)

(b)

(a)

(b)

IMAGE FORMING APPARATUS HAVING SLIDABLE CONTROL PORTION

CROSS-REFERENCE TO RELATED APPLICATIONS

The present application claims priority upon Japanese Patent Application No. 2005-239737 filed in Japan on Aug. 22, 2005, the entire contents of which are hereby incorporated by reference.

BACKGROUND OF THE INVENTION

1. Field of the Invention

The present invention relates to image forming apparatuses in which a control portion of an image forming unit and an opening cover from which the internal portion of an apparatus main body including the image forming unit can be exposed are provided on the upper face, the front face, or the portion from the upper face to the front face of the apparatus main body.

2. Prior Art

Examples of image forming apparatuses (such as copiers, printers, or facsimiles, or compound machines of these) that have been conventionally used include an apparatus in which a control portion that is provided with various control keys, a display panel, and other components is disposed directly next to an opening cover that is provided on the upper face of the image forming apparatus main body, and in which the control portion is fixed on the apparatus main body, and an apparatus in which a control portion is provided on an opening cover that can swing up and down (see JP 2002-351282A (hereinafter, referred to as "the Patent Document")).

In the former image forming apparatus in which the control portion is fixed directly next to the opening cover, the control portion is fixed on the upper face of the apparatus main body, and thus the visibility from above is ensured, so that it is easy for a user to control the apparatus.

However, in this image forming apparatus, it cannot be helped but to make the output port (hereinafter, referred to as "opening") narrower by the area occupied by the control portion on the upper face of the apparatus main body, and thus there is a problem in that it is difficult to deal with troubles and to perform maintenance when the opening cover is opened and a toner container and a process unit (a photosensitive drum, and a unit including a developing device and other components for forming a toner image on the photosensitive drum) inside the apparatus main body are detached. Furthermore, it is necessary to use a small toner container and process unit for this narrow opening, and thus the internal space of the apparatus main body cannot be sufficiently utilized.

On the other hand, in the latter image forming apparatus described in the Patent Document, the control portion is provided on the opening cover, and thus it is possible to provide a wide opening, so that it is easy to deal with troubles and to perform maintenance. Furthermore, it is also possible to use a larger toner container and process unit, for example, and thus the internal space of the apparatus main body can be sufficiently utilized.

However, in the image forming apparatus described in the Patent Document, vibrations and shock, for example, caused by an operation to open and close the opening cover are easily transmitted to the control portion directly, and thus it is difficult to ensure the reliability, and for example, there is a possibility that the control portion goes out of order. Furthermore, in a state where the opening cover is open, the control portion has moved to the position at which it cannot be viewed from above the apparatus main body, in accordance with the rotational movement of the opening cover, and thus the apparatus is inconvenient for a user to use. For example, it is difficult to promptly confirm, from the operation position of the user, information displayed on the control portion such as whether or not a paper jam caused during use has been completely cleared, and whether or not a replaced toner container has been properly fixed at a predetermined position.

SUMMARY OF THE INVENTION

The present invention was arrived at in view of the above circumstances, and it is an object thereof to provide a convenient image forming apparatus in which it is easy to deal with troubles and to perform maintenance of the apparatus main body, a large toner container and process unit, for example, can be used, the reliability of the control portion is improved, and the visibility of the control portion is ensured.

A characteristic configuration of the present invention is directed to an image forming apparatus in which a control portion of an image forming unit and an opening cover from which an internal portion of an apparatus main body including the image forming unit can be exposed are provided on an upper face, a front face, or a portion from the upper face to the front face of the apparatus main body, wherein the control portion is attached so as to be capable of sliding to an outer side with respect to the apparatus main body, and at least a part of the internal portion of the apparatus main body is exposed in accordance with an opening movement of the opening cover and a sliding movement of the control portion.

In the image forming apparatus of this configuration, a control portion of an image forming unit is provided on an upper face, a front face, or a portion from the upper face to the front face of the apparatus main body. Thus, the visibility from above or the front of the control portion during use is ensured, so that it is easy for a user to control the apparatus. Furthermore, an opening cover is also provided on the upper face, the front face, or the portion from the upper face to the front face of the apparatus main body. Thus, it is possible to simply detach, for example, a toner container and a process unit, so that it is easy to deal with troubles and to perform maintenance.

Furthermore, the control portion is attached so as to be capable of sliding to an outer side with respect to the apparatus main body, and at least a part of the internal portion of the apparatus main body is exposed in accordance with an opening movement of the opening cover and a sliding movement of the control portion. Thus, when the opening cover is opened and the control portion is slidingly moved to the outer side of the apparatus main body, it is possible to obtain a wider opening than that in a conventional image forming apparatus in which the control portion is fixed on the apparatus main body directly next to the opening cover.

Accordingly, the internal portion of the apparatus main body is exposed more widely, and it is possible to attach or detach, for example, the toner container and the process unit more easily. Furthermore, it is possible to deal with troubles such as a paper jam and to perform maintenance such as cleaning of the internal portion and replacement of the toner container more easily. Furthermore, it is possible to use, for example, a larger toner container and process unit, and thus the internal space of the apparatus main body can be sufficiently utilized.

Furthermore, the control portion slides to the outer side of the apparatus main body. Thus, vibrations and shock, for example, caused by an operation to open and close the opening cover are transmitted less to the control portion than in a conventional image forming apparatus in which the control portion is provided on the opening cover that can swing up and down. Thus, the operation of the control portion is stabilized and the reliability is improved. Furthermore, the control portion stays on the upper face, the front face, or the portion from the upper face to the front face of the apparatus main body even after the control portion has slid. Thus, the visibility from above or front is ensured, so that it is possible for the user to deal with troubles and to perform maintenance while looking at the control portion.

In this manner, the image forming apparatus of this configuration is more convenient for the user.

In the image forming apparatus according to the present invention, it is also possible that the opening cover is opened and closed by swinging using, as a fulcrum, a support portion that is provided on the upper face or the front face, or the vicinity thereof.

In the image forming apparatus of this configuration, it is possible to form an opening on at least one of the upper face and the front face simply by swinging the opening cover. It is possible to easily operate this opening cover.

In the image forming apparatus according to the present invention, it is also possible that the opening cover and the control portion are provided adjacent to each other, and the control portion can slide in a direction away from the opening cover.

In the image forming apparatus of this configuration, the opening cover and the control portion are provided adjacent to each other. Thus, it is possible to form a wide opening by opening the opening cover and by sliding the control portion in the direction away from the opening cover.

In the image forming apparatus according to the present invention, it is also possible that an interlock mechanism for interlocking between the opening movement of the opening cover and the sliding movement of the control portion is provided.

In the image forming apparatus of this configuration, it is possible to interlock between the opening movement of the opening cover and the sliding movement of the control portion using the interlock mechanism. Thus, it is not necessary to move the opening cover and the control portion separately. More specifically, simply by performing one operation to open or close the opening cover, or to slide the control portion, it is possible to operate both the opening cover and the control portion. Accordingly, the apparatus is more convenient for the user.

In the image forming apparatus according to the present invention, it is also possible that the interlock mechanism is a gear mechanism having a first rack that is provided on the opening cover and that extends in a direction of the opening movement, a second rack that is provided on the control portion and that extends in a direction of the sliding movement, and at least one gear for interlocking between the first rack and the second rack.

In the image forming apparatus of this configuration, the opening movement of the opening cover and the sliding movement of the control portion are interlocked using the gear mechanism. Thus, the movement is reliably transmitted from one of the opening cover and the control portion to the other.

Furthermore, this gear mechanism can be achieved by a relatively simple configuration obtained simply by combining a plurality of gears. Thus, the mechanism is excellent in terms of the reliability of the operation.

In the image forming apparatus according to the present invention, it is also possible that the interlock mechanism is a belt mechanism having swivels that are respectively provided on the opening cover and the control portion, a belt member with both end portions caught at the swivels, and a pulley group for converting an upward movement of the belt member on the side of the opening cover into a movement to the outer side on the side of the control portion.

In the image forming apparatus of this configuration, the belt mechanism is used for interlocking between the opening movement of the opening cover and the sliding movement of the control portion. Thus, the movement can be reliably transmitted from one of the opening cover and the control portion to the other, as in the above configuration using the gear mechanism.

Furthermore, this belt mechanism can be constituted by, for example, a string-like elastic belt and a plurality of pulleys. Thus, the mechanism can operate even without ensuring a very wide space in which the components can move. Thus, a slight space is sufficient for installing the belt mechanism, so that it is possible to make the image forming apparatus more compact.

In the image forming apparatus according to the present invention, it is also possible that a movement range of the opening cover includes a first movement range in which the sliding movement of the control portion is restricted and a second movement range, with a larger opening degree than that in the first movement range, in which the sliding movement of the control portion is allowed.

In the image forming apparatus of this configuration, a movement range of the opening cover is divided into a first movement range and a second movement range. Thus, when the opening cover is in the first movement range, the sliding movement of the control portion is restricted. When the opening cover is in the second movement range with a larger opening degree than that in the first movement range, the sliding movement of the control portion is allowed.

The first movement range is a movement range used when it is necessary to open the opening cover in a relatively slight manner in order to, for example, confirm the remaining amount in the toner container that is one component of the image forming unit. In this case, an operation is not performed in which the image forming unit is attached to and detached from the apparatus main body, and thus no problem is caused even when the sliding movement of the control portion is restricted. When the sliding movement is restricted, a state is kept in which the vicinity of an attachment portion of the image forming unit is covered from above by the control portion, and thus the risk that the user will mistakenly touch the vicinity of the attachment portion by hand, for example, is reduced.

The second movement range is a movement range used when it is necessary to widely open the opening cover in order to attach and detach the image forming unit. In this case, the sliding movement of the control portion is allowed, and thus it is possible to ensure a wide opening of the apparatus main body, so that the work efficiency is improved.

In this manner, in the image forming apparatus of this configuration, when, for example, an ordinary confirmation operation of the internal portion is performed, the internal portion of the apparatus main body is exposed to the least possible, and thus unexpected troubles are prevented from occurring, and when it is necessary to, for example, replace the toner container, the internal portion of the apparatus main body is exposed more by sliding the control portion, and thus the convenience for the user is improved.

In the image forming apparatus according to the present invention, it is also possible that an interlock mechanism for interlocking between the opening movement of the opening cover and the sliding movement the control portion in the second movement range is provided.

In the image forming apparatus of this configuration, the opening movement of the opening cover and the sliding movement the control portion are interlocked in the second movement range using the interlock mechanism. Thus, it is possible to move both the opening cover and the control portion at the same time with one action, so that the apparatus becomes more convenient.

In the image forming apparatus according to the present invention, it is also possible that a lock mechanism for locking the control portion in the first movement range and for canceling lock on the control portion in the second movement range is provided.

In the image forming apparatus of this configuration, the lock mechanism reliably prevents the control portion from slidingly moving in the first movement range, and allows the control portion to slidingly move in the second movement range. Thus, it is possible to achieve both safety and convenience for the user.

DETAILED DESCRIPTION OF PREFERRED EMBODIMENTS

Hereinafter, embodiments of the present invention are described based on the drawings.

Figure 1:
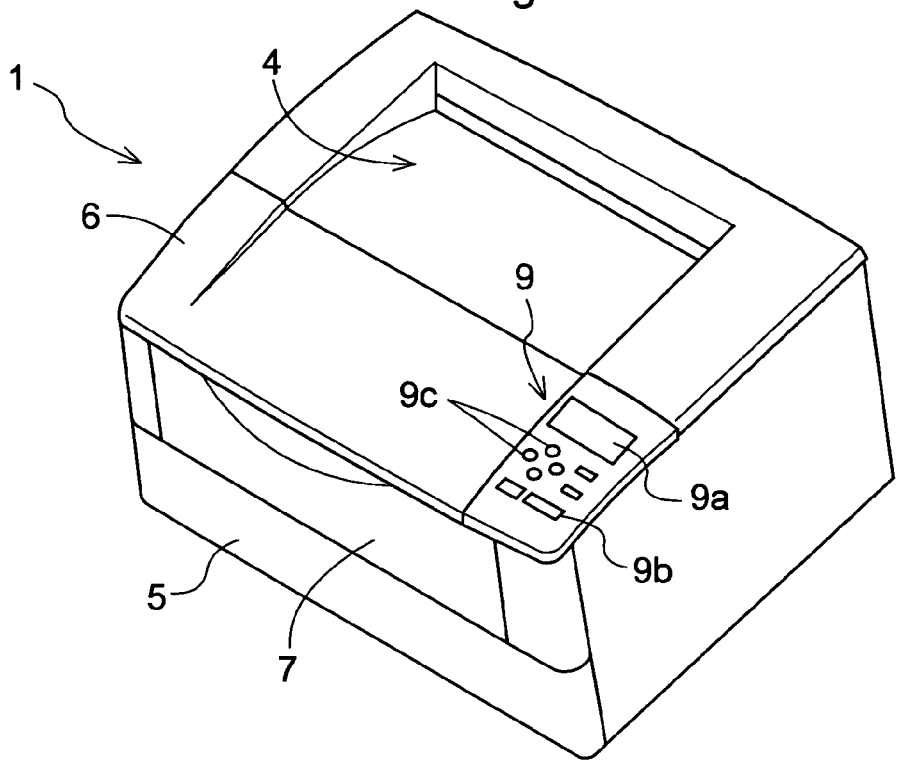
FIG. 1 is a perspective view of a printer main body to which the present invention is applied.

FIG. 1 is a perspective view of the appearance of a printer that is one example of an image forming apparatus to which the present invention can be applied. The internal portion of a printer main body 1 as an apparatus main body includes an image forming unit, and accommodates, for example, a toner container 2 and a process unit 3 as components of the image forming unit such that they can be detached, and is provided with a paper feed cassette 5 for accommodating paper, a transport unit (constituted by a transport roller and a transport belt) (not shown) for transporting the paper, and a fixing unit (not shown) for fixing a toner image that has been formed by the process unit 3 onto the paper, for example.

Paper that has been fed from the paper feed cassette 5 passes through a transport path of the transport unit and is transported to the process unit 3, a toner image is formed on the paper, and the toner image is fixed with heat by the fixing unit. The paper that has undergone the fixing process is discharged via the transport unit to a paper discharge tray 4 that is provided on the upper face of the printer main body 1.

Furthermore, the upper face of the printer main body 1 is provided with an opening cover 6 that can be opened and closed by swinging the upper portion of the printer main body 1 up and down using, as a fulcrum, a support portion 6*a* that is provided in the vicinity of the middle in the fore-and-aft direction of the upper face, and a control panel 9 (control portion) that is adjacent to the opening cover 6 and that can slide to the outer side (that is, to the side away from the opening cover) with respect to the printer main body 1. The front face of the printer main body 1 is provided with a front cover 7 that can be opened and closed by swinging the front face of the printer main body 1 using, as a fulcrum, a support portion 7*a* that is provided in the vicinity of the middle in the vertical direction of the front face. The control panel 9 is provided with a liquid crystal display panel 9*a* for displaying an operation state and other information for the user, a cancel key 9*b* for stopping printing that is being performed, and setting keys 9*c* for changing set values, for example.

It should be noted that the opening cover 6 or the front cover 7 may be provided on the upper face, the front face, or the portion from the upper face to the front face of the printer main body 1. The configurations in which the opening cover 6 or the front cover 7 is provided on the portion from the upper face to the front face include a configuration in which the cover is inclined or curved from the upper face to the front face. Also in these cases, the opening cover 6 or the front cover 7 can be opened and closed by swinging using, as a fulcrum, a support portion that is provided on the upper face or the front face of the printer main body 1, or in the vicinity thereof.

Figure 2:
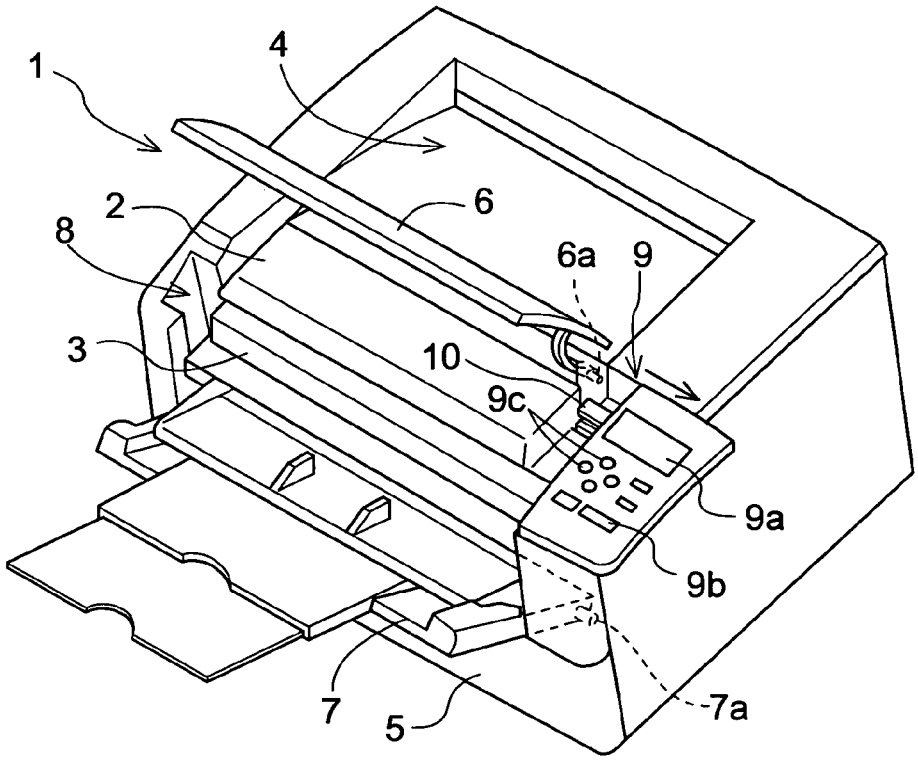
FIG. 2 is a perspective view showing a state in which an opening is formed by opening an opening cover, a control panel, and a front cover of the printer main body to which the present invention is applied.

As shown in FIG. 2, for example, when dealing with troubles such as a paper jam that is caused inside the transport unit, or performing maintenance such as cleaning of the internal portion of the printer main body or replacement of the toner container, it is possible to form an opening 8 by opening the opening cover 6, by sliding the control panel 9 to the outer side with respect to the printer main body 1, and by opening the front cover 7. Accordingly, at least a part of the internal portion of the printer main body 1 is exposed.

Thus, it is possible for the user to easily detach the toner container 2 and the process unit 3 from inside the opening 8. Then, it is possible to replace the toner container 2 with a new toner container, to remove paper jammed in the transport unit or the like, or to perform regular cleaning of the internal portion of the printer main body.

Vibrations caused by, for example, an operation to open and close the opening cover 6 and maintenance are transmitted less to the control panel 9 than in a conventional configuration in which a control panel is provided on an opening cover that can swing up and down. Furthermore, the control panel 9 stays on the upper face of the printer main body 1 even after it has slid to the outer side of the printer main body 1, and thus the visibility from above is ensured, so that it is possible for the user to deal with troubles and to perform maintenance as described above while looking at the display on the control panel 9. In this manner, the printer main body 1 to which the present invention is applied is convenient for the user.

Figure 3:
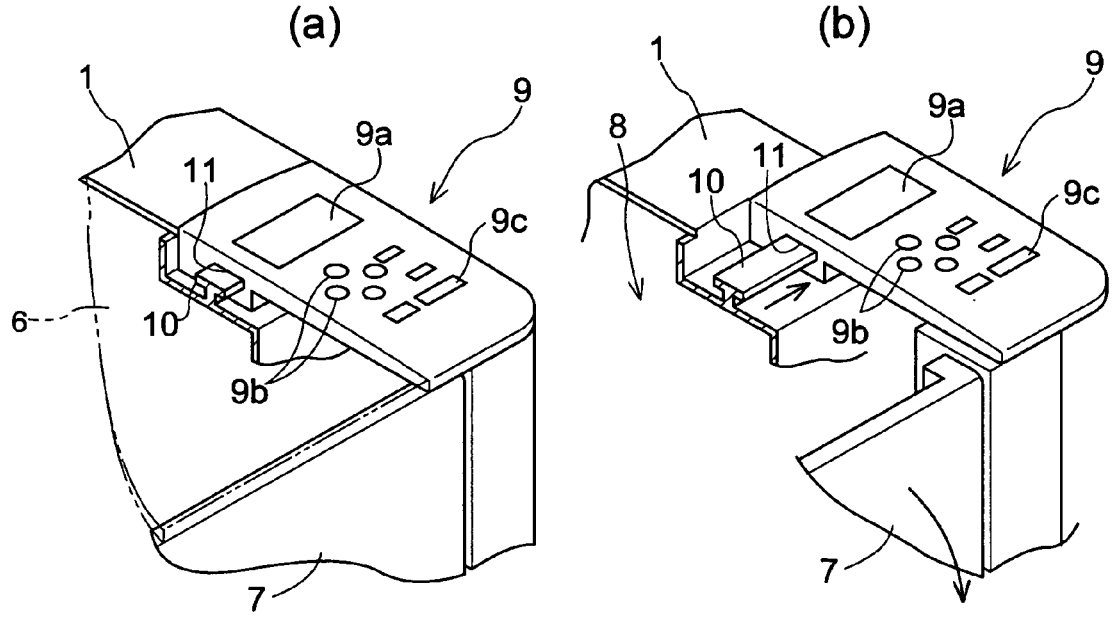
FIG. 3 shows perspective views showing a slide mechanism of the control panel in the printer main body to which the present invention is applied.

FIG. 3 shows perspective views showing a slide mechanism of the control panel 9 in the printer main body 1 to which the present invention is applied.

In the vicinity of the upper face of the printer main body 1 on which the control panel 9 is mounted, a guide rail 10 with a T-shaped cross-section is provided along the width direction of the control panel 9. The lower portion of the control panel 9 is provided with a T-shaped rail groove 11 to which the guide rail 10 can be fittingly inserted. As shown in FIGS. 3(*a*)

and 3(*b*), the control panel 9 is configured such that it can slidingly move freely on the guide rail 10 in the longitudinal direction.

Figure 4:
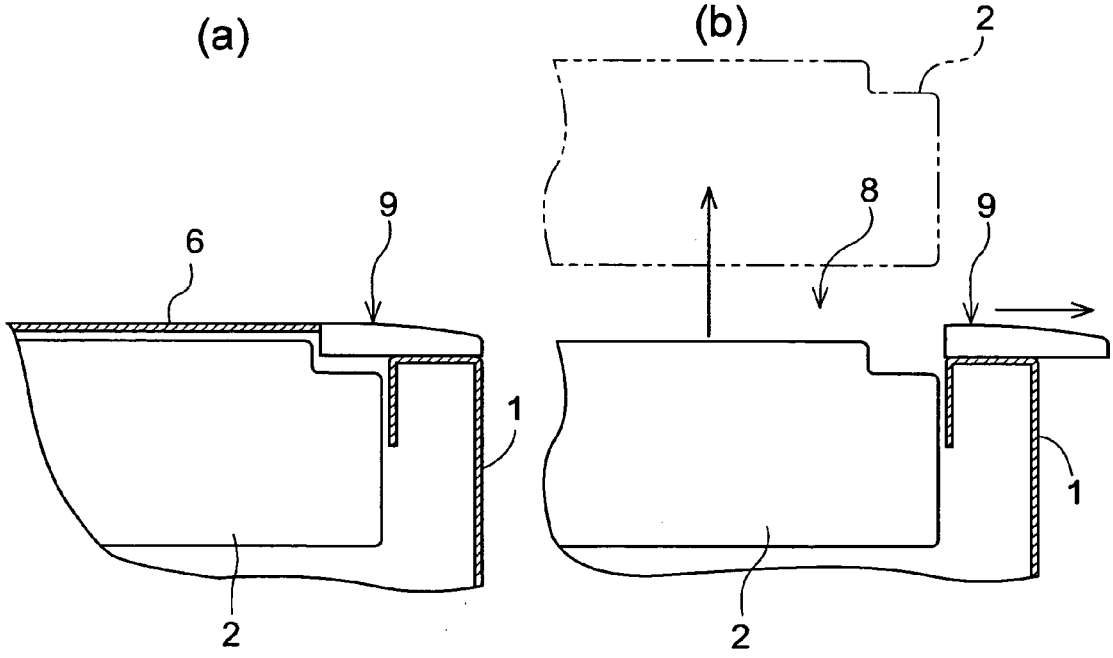
FIG. 4 shows cross-sectional views of the printer main body to which the present invention is applied.

FIG. 4 schematically shows the cross-section of the printer main body 1 when viewed from front. As shown in FIG. 4, when the control panel 9 is slid to the outer side with respect to the printer main body 1, it is possible to widely expose the internal portion by providing the wider opening 8 than that in a conventional printer in which the control panel 9 is fixed directly next to the opening cover 6.

It should be noted that the slide mechanism of the control panel 9 is not limited to the above configuration, and any configuration can be applied as long as it is a configuration in which the control panel 9 can slide when the opening cover 6 is opened, and the control panel 9 can stay on the upper face of the printer main body 1 even after it has slid.

Furthermore, it is also possible to apply a configuration in which the opening movement of the opening cover 6 and the sliding movement of the control panel 9, or the opening movement of the opening cover 6 and the sliding movement of the control panel 9 and the opening movement of the front cover 7 are individually performed independently of each other, or a configuration in which the opening 8 is formed by interlocking these movements.

For example, a configuration is conceivable in which when the opening cover 6 is opened, the control panel 9 is interlocked and automatically slides to the lateral outer side or the front outer side of the printer main body 1. This configuration in which the opening movement of the opening cover 6 and the sliding movement of the control panel 9 are interlocked is advantageous in that it is not necessary to move the opening cover 6 and the control panel 9 separately. More specifically, simply by performing one operation to open or close the opening cover 6, or to slide the control panel 9, it is possible to operate both the opening cover 6 and the control panel 9 at the same time. Accordingly, the apparatus is more convenient for the user.

The following is a description concerning concrete examples of the configuration in which the opening movement of the opening cover 6 and the sliding movement of the control panel 9 are interlocked in a printer to which the present invention is applied.

Gear Mechanism

Figure 5:
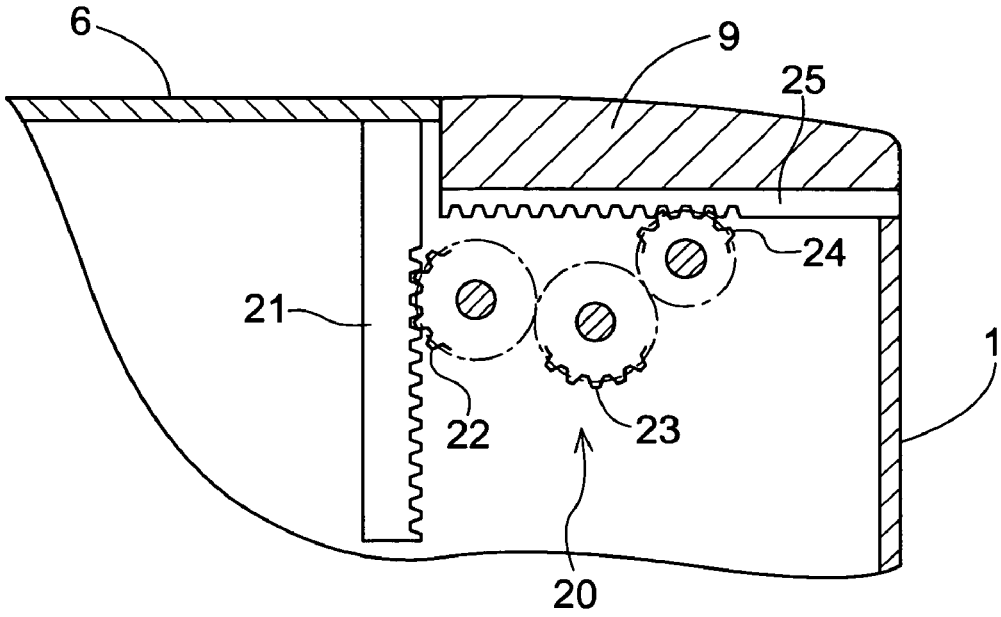
FIG. 5 shows enlarged views of the main portions of the printer main body that is provided with a gear mechanism.
Figure 5:
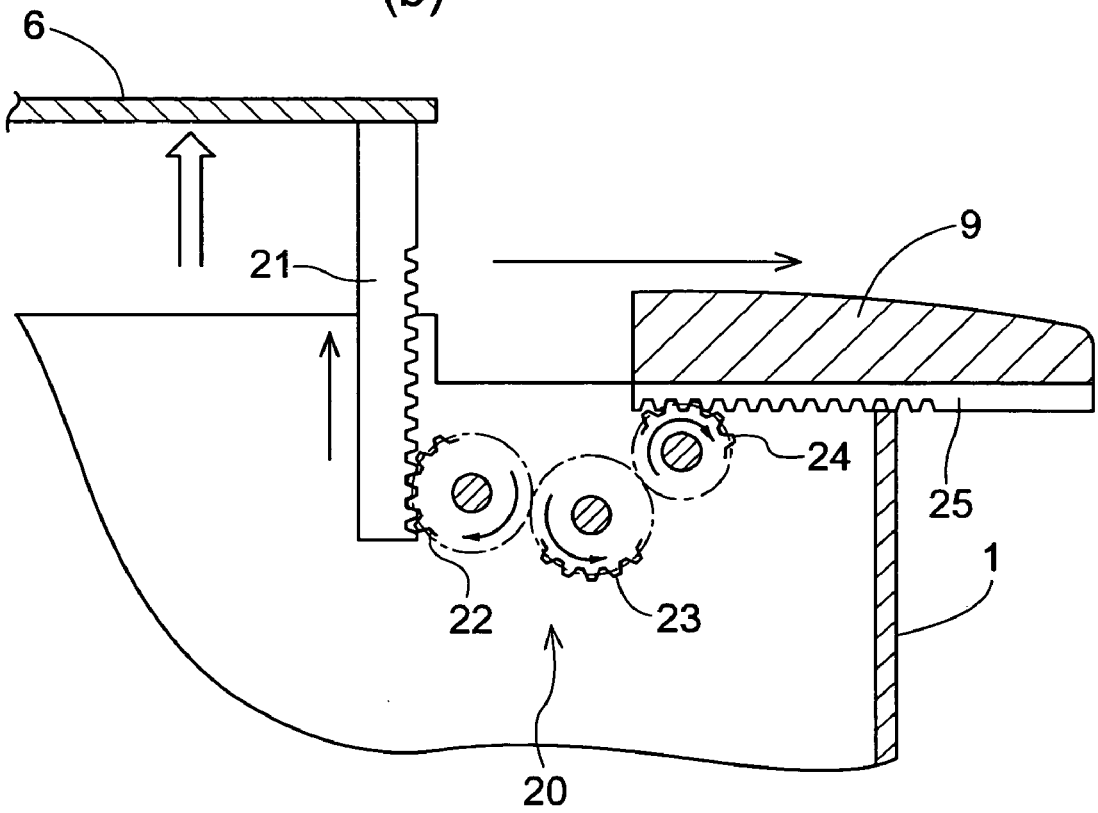

FIG. 5 shows enlarged views of the main portions of the printer main body 1 that is provided with a gear mechanism 20 as an interlock mechanism between the opening cover 6 and the control panel 9.

As shown in FIG. 5(*a*), the gear mechanism 20 is constituted by a first rack 21 that is provided on the opening cover 6 and that extends in the direction of the opening movement, a first pinion 22 that is engaged with the first rack 21, a reverse gear 23 that lets the first pinion 22 rotate in reverse, a second pinion 24 that is engaged with the reverse gear 23, and a second rack 25 that is provided on the control panel 9, that extends in the direction of the sliding movement, and that is engaged with the second pinion 24.

As shown in FIG. 5(*b*), when the opening cover 6 is pulled upward, the movement of the first rack 21 is transmitted via the first pinion 22, the reverse gear 23, and the second pinion 24 to the second rack 25. As a result, the control panel 9 slides to the outer side with respect to the printer main body 1. On the other hand, when the opening cover 6 is pulled downward, by the movement opposite to the above, the control panel 9 automatically slides to the inner side of the printer main body 1, and thus the opening 8 is closed.

In this manner, it is possible to interlock between the opening movement of the opening cover 6 and the sliding movement of the control panel 9 using the gear mechanism 20. With this gear mechanism 20, the movement is reliably transmitted from the opening cover 6 to the control panel 9.

Belt Mechanism

Figure 6:
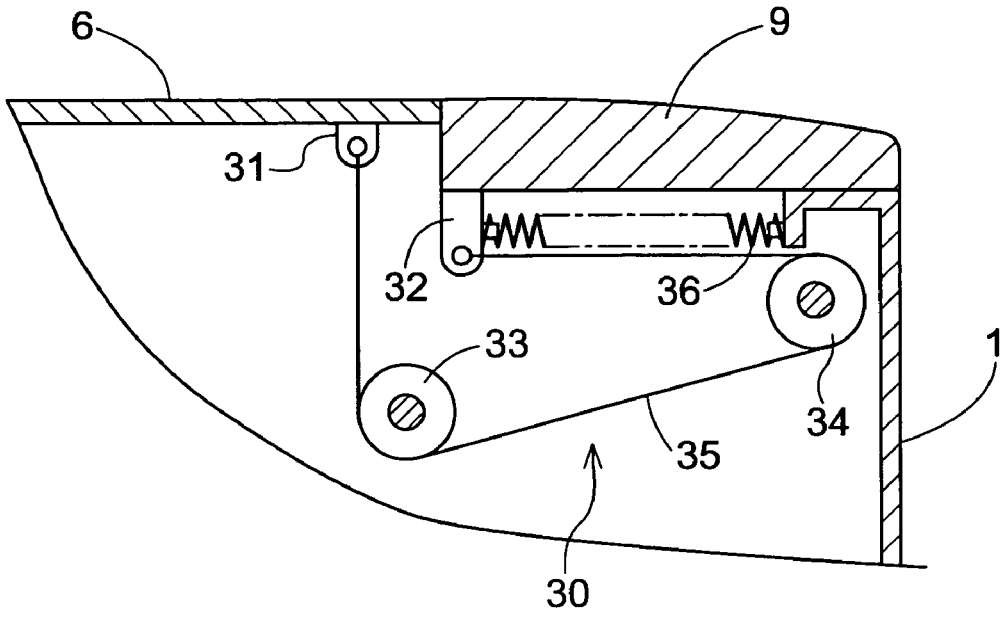
FIG. 6 shows enlarged views of the main portions of the printer main body that is provided with a belt mechanism.
Figure 6:
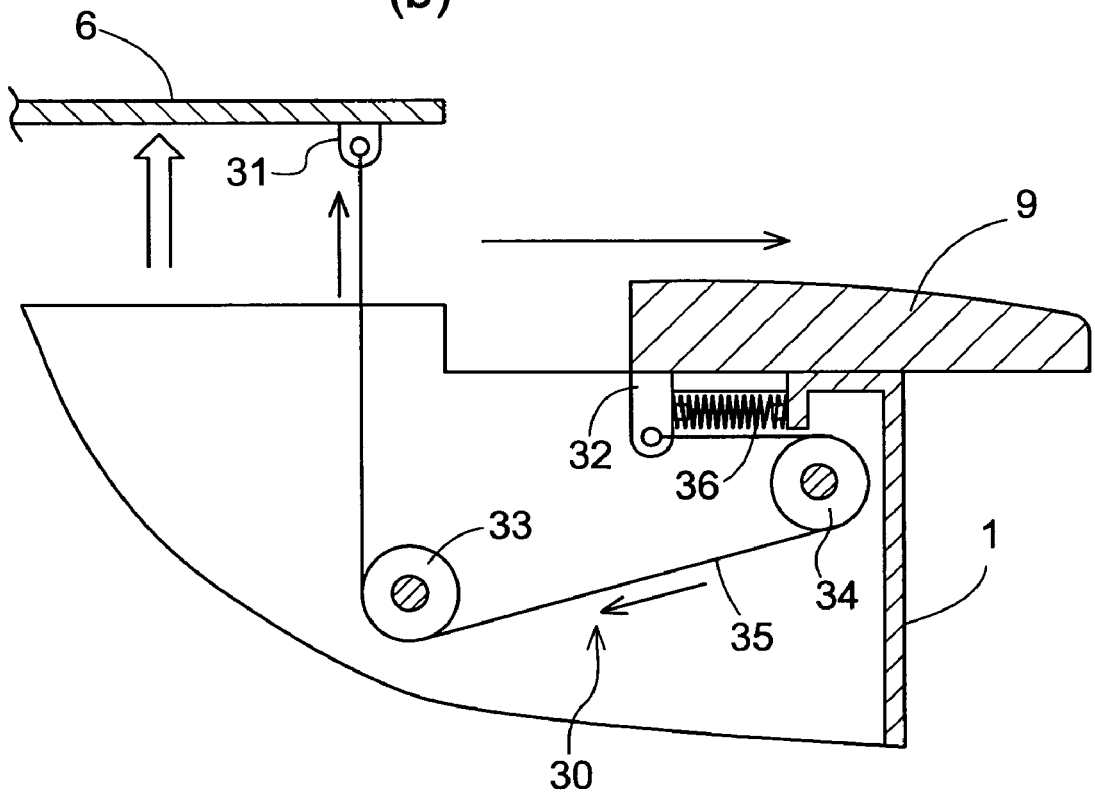

FIG. 6 shows enlarged views of the main portions of the printer main body 1 that is provided with a belt mechanism 30 as an interlock mechanism between the opening cover 6 and the control panel 9.

As shown in FIG. 6(*a*), the belt mechanism 30 is constituted by a first swivel 31 that is provided on the opening cover 6, a second swivel 32 that is provided on the control panel 9, a first pulley 33 and a second pulley 34 that are provided on the printer main body 1, and a belt 35 attached between these components. Both ends of the belt 35 are respectively caught at the first swivel 31 and the second swivel 32. The first pulley 33 and the second pulley 34 convert the upward movement of the belt 35 on the side of the opening cover 6 into the movement to the outer side on the side of the control panel 9. Furthermore, a spring 36 for biasing the control panel 9 toward the inner side of the printer main body 1 is provided between the second swivel 32 and the printer main body 1.

As shown in FIG. 6(*b*), when the opening cover 6 is pulled upward, in accordance with this movement, the first swivel 31 pulls the belt 35 upward, and the force applied to the belt 35 acts via the first pulley 33 and the second pulley 34 on the second swivel 32. As a result, the control panel 9 slides to the outer side with respect to the printer main body 1. On the other hand, when the opening cover 6 is pulled downward, the control panel 9 automatically slides to the inner side of the printer main body 1 by the action of the spring 36, and thus the opening 8 is closed.

In this manner, it is possible to interlock between the opening movement of the opening cover 6 and the sliding movement of the control panel 9 using the belt mechanism 30. With this belt mechanism 30, the movement is reliably transmitted from the opening cover 6 to the control panel 9. Furthermore, the belt mechanism 30 can be constituted by, for example, the string-like elastic belt 35 and the plurality of pulleys 33 and 34, and thus this mechanism can operate even without ensuring a very wide space in which the components can move. Thus, a slight space is sufficient for installing the belt mechanism 30, so that it is possible to make the printer main body 1 more compact.

Link Mechanism

The above-described printer main body 1 to which the present invention is applied has the configuration in which the opening movement of the opening cover 6 and the sliding movement of the control panel 9 are interlocked linearly from the start to the end of the movements.

However, in an actual state, it is not necessary to open the opening cover 6 so widely, for example, when only performing a confirmation operation such as checking the remaining amount in the toner container that is one component of the image forming unit, and thus it is not necessary to slide the control panel 9 to the outer side. On the contrary, in this case, it is considered to be more preferable to restrict the sliding movement of the control panel 9 in that a state is kept in which the vicinity of an attachment portion of the toner container is covered from above by the control panel 9, and thus the risk that the user will mistakenly touch the vicinity of the attachment portion by hand, for example, is reduced. On the other hand, it is necessary to widely open the opening cover 6 in order to improve the work efficiency when the toner container or other components are attached and detached. In this case, it is necessary that the sliding movement of the control panel 9 is allowed.

Thus, in order to achieve both safety and convenience, it is preferable to divide a movement range of the opening cover 6 into a first movement range in which the sliding movement of the control panel 9 is restricted and a second movement range, with a larger opening degree than that in the first movement range, in which the sliding movement of the control panel 9 is allowed. Examples of a configuration for achieving these movement ranges include the printer main body 1 that is provided with a link mechanism 40 shown in FIG. 7.

Figure 7:
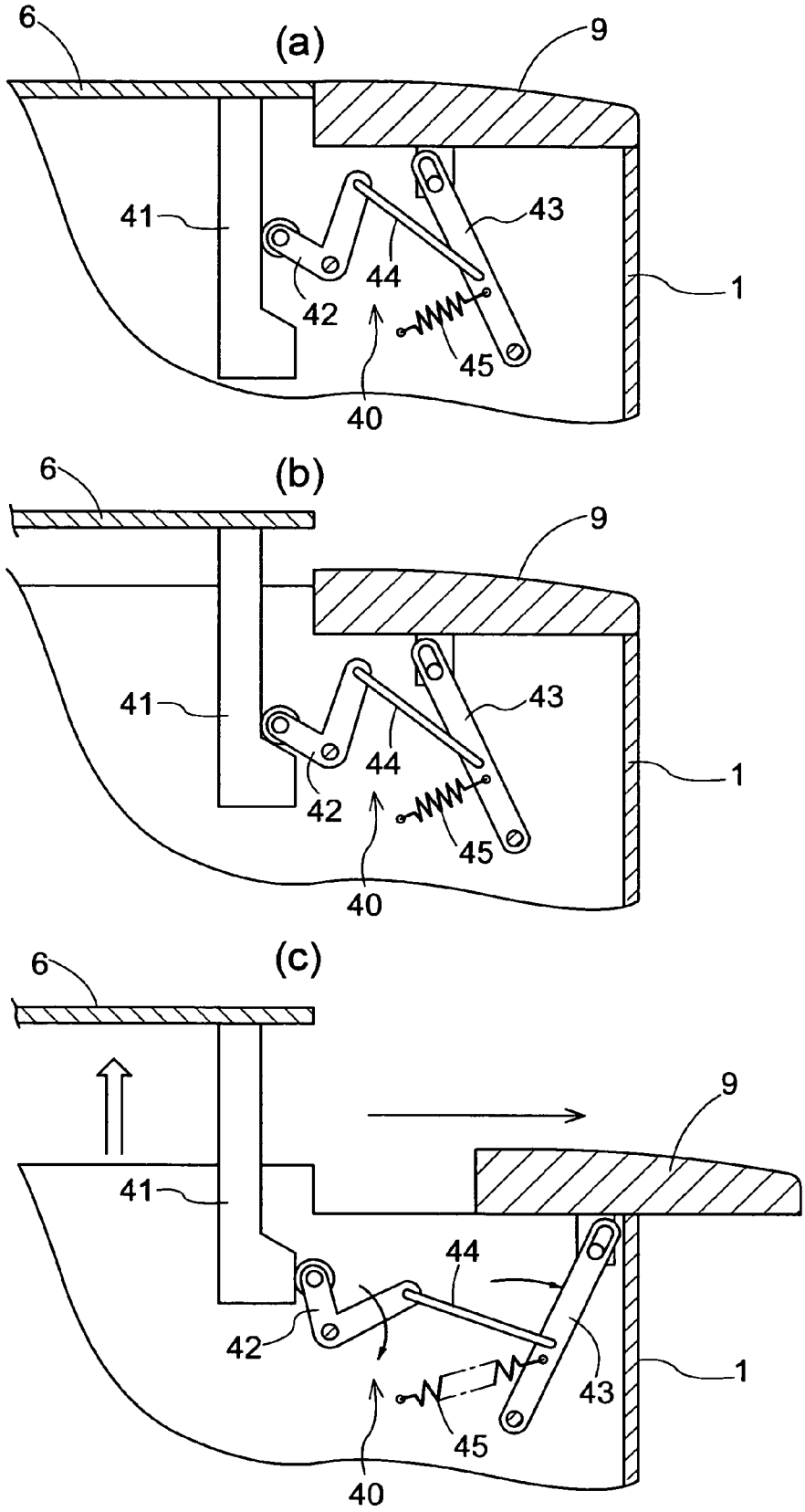
FIG. 7 shows enlarged views of the main portions of the printer main body that is provided with a link mechanism.

As shown in FIG. 7(*a*), the link mechanism 40 is constituted by a cam 41 that is provided on the opening cover 6, a first rotation lever 42 that can rotate while being in contact with the outer periphery of the cam 41, a second rotation lever 43 that is provided on the control panel 9, and a link 44 for coupling the first rotation lever 42 and the second rotation lever 43. A spring 45 for biasing the control panel 9 toward the inner side of the printer main body 1 is provided between the second rotation lever 43 and the printer main body 1.

When the opening cover 6 is pulled upward, in a range where the first rotation lever 42 is in contact with a narrow portion of the cam 41 as shown in FIG. 7(*b*), the first rotation lever 42 does not rotate, and thus no force is applied to the link 44, so that the control panel 9 does not slide. More specifically, this range is the first movement range in which the sliding movement of the control panel 9 is restricted. Next, when the opening cover 6 is pulled further upward as shown in FIG. 7(*c*), the first rotation lever 42 is brought into contact with a wide portion of the cam 41, and starts to rotate clockwise at the same time. This rotational force is transmitted via the link 44 to the second rotation lever 43, and thus the control panel 9 is slid to the outer side with respect to the printer main body 1 resisting the spring 45. More specifically, the range in which the first rotation lever 42 is in contact with the wide portion of the cam 41 is the second movement range in which the sliding movement of the control panel 9 is allowed. In this the second movement range, the opening degree of the opening cover 6 is larger than that in the first movement range. When the opening cover 6 is pulled downward, the control panel 9 automatically slides to the inner side of the printer main body 1 by the action of the spring 45, and thus the opening 8 is closed.

Lock Mechanism

Figure 8:
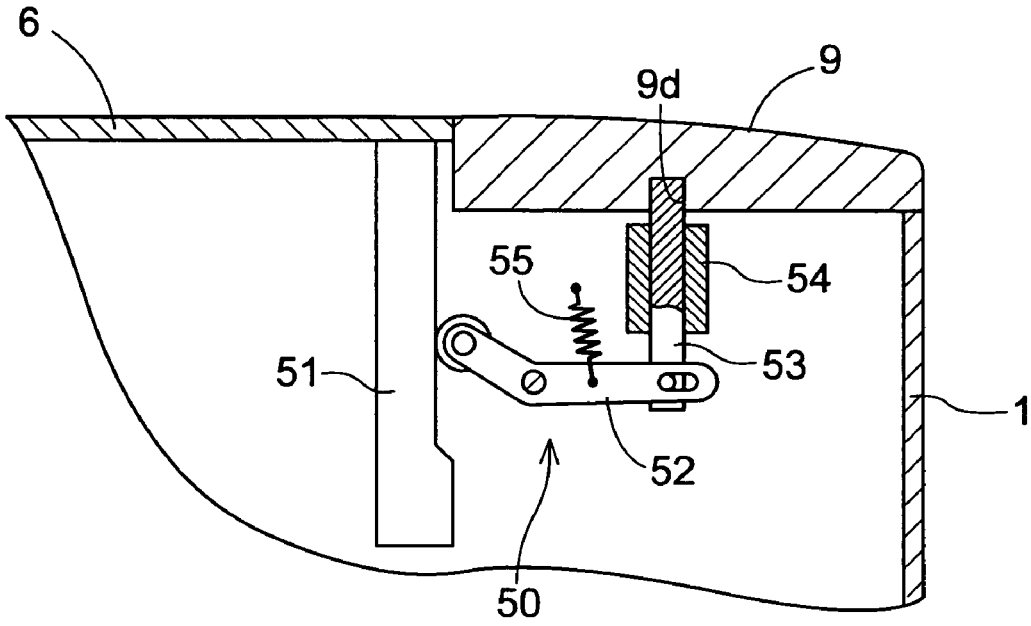
FIG. 8 shows enlarged views of the main portions of the printer main body that is provided with a lock mechanism.
Figure 8:
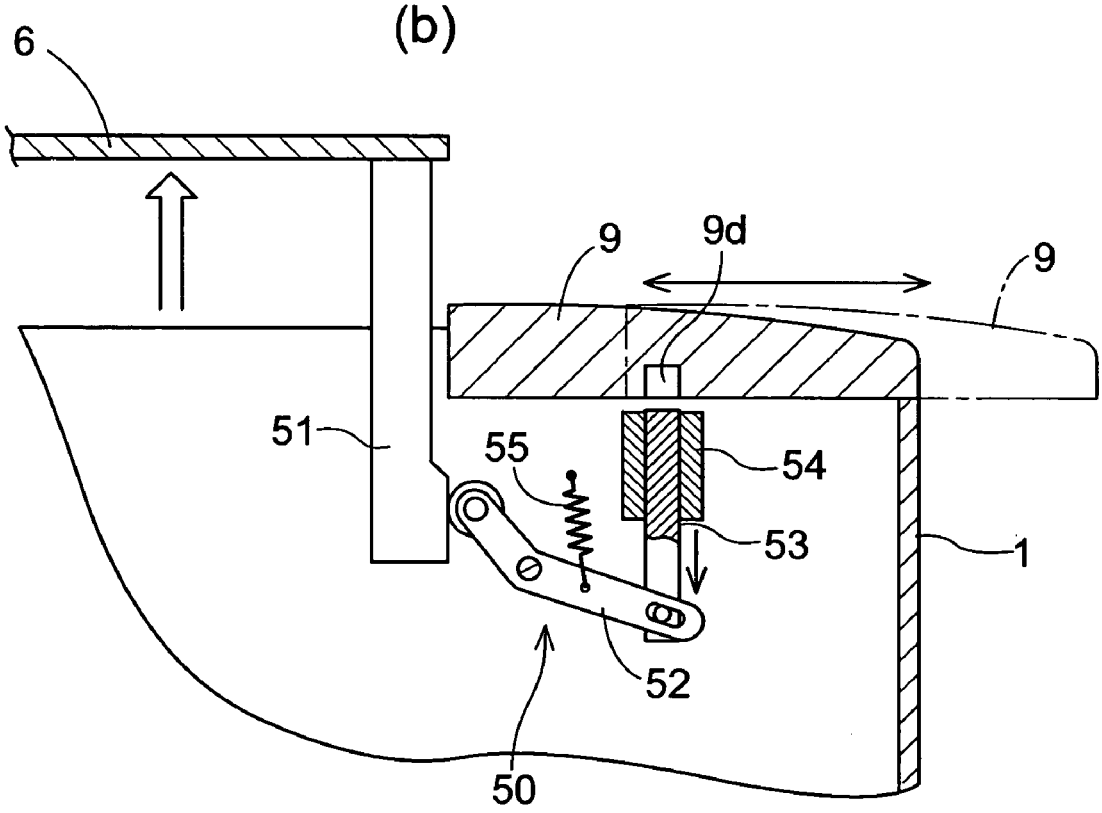

In the first movement range described above, it is also possible to apply a configuration in which a lock mechanism 50 shown in FIG. 8 is provided in order to reliably regulate the sliding movement of the control panel 9.

As shown in FIG. 8(*a*), the lock mechanism 50 is constituted by a cam 51 that is provided on the opening cover 6, a rotation lever 52 that can rotate while being in contact with the outer periphery of the cam 51, and a lock member 53 that can be engaged with an engagement hole 9*d* provided on the control panel 9. The lock member 53 is supported by a guide member 54 such that the lock member 53 can slidingly move, and a spring 55 for biasing the lock member 53 in the direction in which the lock member 53 is engaged with the engagement hole 9*d* is provided between the rotation lever 52 and the printer main body 1.

In the lock mechanism 50 in this embodiment, when the opening cover 6 is pulled upward, in the first movement range in which the rotation lever 52 is in contact with a narrow portion of the cam 51 as shown in FIG. 8(*a*), the lock member 53 is engaged with the engagement hole 9*d* by the biasing force of the spring 55. Accordingly, the sliding movement of the control panel 9 to the outer side with respect to the printer main body 1 is prohibited. However, when the opening cover 6 is pulled further upward and the rotation lever 52 is brought into contact with a wide portion of the cam 51 as shown in FIG. 8(*b*), the rotation lever 52 starts to rotate clockwise at the same time and pulls out the lock member 53 downward resisting the spring 55. At that time, the control panel 9 is allowed to be manually slid.

In this manner, in the printer main body 1 to which the present invention is applied, when, for example, an ordinary confirmation operation of the internal portion is performed, the internal portion of the printer main body 1 is exposed to the least possible as in the first movement range, and thus unexpected troubles are prevented from occurring, and when it is necessary to, for example, replace the toner container, the internal portion of the printer main body 1 is exposed more by sliding the control panel 9 as in the second movement range, and thus the convenience for the user is improved.

It should be noted that the lock mechanism 50 can be configured also in combination with the gear mechanism 20 in FIG. 5, the belt mechanism 30 in FIG. 6, or the link mechanism 40 in FIG. 7.

Other Embodiment

Image forming apparatuses to which the present invention can be applied are not limited to the printer shown in the embodiments, and it is also possible to apply the present invention to copiers or facsimiles, or complex machines of these.

What is claimed is:

1. An image forming apparatus in which a control portion and an opening cover from which an internal portion of an apparatus main body including an image forming unit can be exposed are provided on an upper face, a front face, or a portion from the upper face to the front face of the apparatus main body, wherein the control portion is attached so as to be capable of sliding to an outer side with respect to the apparatus main body, at least a part of the internal portion of the apparatus main body is exposed in accordance with an opening movement of the opening cover and a sliding movement of the control portion, and the opening cover is opened and closed by swinging using, as a fulcrum, a support portion that is provided on the upper face or the front face, or the vicinity thereof.

2. An image forming apparatus in which a control portion and an opening cover from which an internal portion of an apparatus main body including an image forming unit can be exposed are provided on an upper face, a front face, or a portion from the upper face to the front face of the apparatus main body, wherein the control portion is attached so as to be capable of sliding to an outer side with respect to the apparatus main body, at least a part of the internal portion of the apparatus main body is exposed in accordance with an opening movement of the opening cover and a sliding movement of the control portion, and an interlock mechanism for interlocking between the opening movement of the opening cover and the sliding movement of the control portion is provided.

3. The image forming apparatus according to claim 2, wherein the interlock mechanism is a gear mechanism having a first rack that is provided on the opening cover and that extends in a direction of the opening movement, a second rack that is provided on the control portion and that extends in a direction of the sliding movement, and at least one gear for interlocking between the first rack and the second rack.

4. The image forming apparatus according to claim 2, wherein the interlock mechanism is a belt mechanism having swivels that are respectively provided on the opening cover and the control portion, a belt member with both end portions caught at the swivels, and a pulley group for converting an upward movement of the belt member on the side of the opening cover into a movement to the outer side on the side of the control portion.

5. An image forming apparatus in which :a control portion and an opening cover from which an internal portion of an apparatus main body including an image forming unit can be exposed are provided on an upper face, a front face, or a portion from the upper face to the front face of the apparatus main body, wherein the control portion is attached so as to be capable of sliding to an outer side with respect to the apparatus main body, at least a part of the internal portion of the apparatus main body is exposed in accordance with an opening movement of the opening cover and a sliding movement of the control portion, and a movement range of the opening cover includes a first movement range in which the sliding movement of the control portion is restricted and a second movement range, with a larger opening degree than that in the first movement range, in which the sliding movement of the control portion is allowed.

6. The image forming apparatus according to claim 5, wherein an interlock mechanism for interlocking between the opening movement of the opening cover and the sliding movement the control portion in the second movement range is provided.

7. The image forming apparatus according to claim 5, wherein a lock mechanism for locking the control portion in the first movement range and for canceling lock on the control portion in the second movement range is provided.

* * * * *

UNITED STATES PATENT AND TRADEMARK OFFICE

CERTIFICATE OF CORRECTION

PATENT NO. : 7,542,699 B2
APPLICATION NO. : 11/471074
DATED : June 2, 2009
INVENTOR(S) : Kawasaki It is certified that error appears in the above-identified patent and that said Letters Patent is hereby corrected as shown below:

Column 11, Line 12, Claim 5, "in which :a" should read -- in which a --

Signed and Sealed this

Seventeenth Day of November, 2009

David J. Kappos

David J. Kappos
*Director of the United States Patent and Trademark Office*